US006033013A

United States Patent [19]

Lee

[11] Patent Number: 6,033,013

[45] Date of Patent: Mar. 7, 2000

[54] MULTIFUNCTIONAL ARMREST FOR CHAIRS

[76] Inventor: Ming-Hao Lee, P.O. Box 63-247, Taichung, Taiwan

[21] Appl. No.: 09/301,031

[22] Filed: Apr. 28, 1999

[51] Int. Cl.[7] ..... A47C 7/54

[52] U.S. Cl. ..... 297/115; 297/411.2; 297/188.19; 297/227

[58] Field of Search ..... 297/411.2, 227, 297/188.14, 188.19, 452.41, 411.43, DIG. 3, 115, 411.22; 248/118

[56] References Cited

U.S. PATENT DOCUMENTS 4,890,883 1/1990 Boerema et al. ..... 297/188.19
4,950,023 8/1990 Waller et al. ..... 297/411.22 X
5,551,755 9/1996 Lindberg ..... 297/115 X
5,845,965 12/1998 Heath et al. ..... 297/188.19
5,853,220 12/1998 Gulich et al. ..... 297/188.19 X

*Primary Examiner*—Anthony D. Barfield
*Attorney, Agent, or Firm*—Alan Kamrath; Oppenheimer Wolff & Donnelly LLP

[57] ABSTRACT

An armrest includes a reactive force-reducing device mounted to an upper side thereof for reducing the reactive force as a result of exerting a force to the armrest. The armrest includes a base and a cover mounted on top of the base, and the reactive force-reducing device is mounted to an upper side of the cover. The base includes a compartment defined therein for receiving articles. The cover includes an end pivotally connected to a first end of the base. The other end of the base includes a first engaging member for releasably engaging with a second engaging member on a second end of the base.

4 Claims, 5 Drawing Sheets

MULTIFUNCTIONAL ARMREST FOR CHAIRS

BACKGROUND OF THE INVENTION

1. Field of the Invention

The present invention relates to a multifunctional armrest for chairs, and more particularly to an armrest that may serve as a reactive force-reducing device as well as an article-receiving device.

2. Description of the Related Art

The armrest of a chair only provides a single function of supporting an arm of the user sitting in the chair. The armrest is usually made of rigid material such that the user, especially a heavy user, might be injured when trying to get up from the chair by exerting a downward force to the armrest. The present invention is intended to provide an improved armrest that mitigates and/or obviates the above problems.

SUMMARY OF THE INVENTION

It is a primary object of the present invention to provide an improved armrest that may serve as a reactive force-reducing device as well as an article-receiving device.

In accordance with a first aspect of the invention, an armrest comprises a reactive force-reducing means mounted to an upper side thereof for reducing the reactive force as a result of exerting a force to the armrest. The armrest includes a base and a cover mounted on top of the base. The reactive force-reducing means is mounted to an upper side of the cover. The base includes a compartment defined therein for receiving articles. The cover includes an end pivotally connected to a first end of the base. A second end of the base includes a first engaging member, and the cover includes a second end with a second engaging member for releasably engaging with the first engaging member. In an embodiment of the invention, the first end of the base includes two spaced ears having aligned first pinholes. The end of the cover includes a pivotal block received between the ears and having a second pinhole. A pin is extended through the first pinholes of the ears and the second pinhole of the pivotal block. The reactive force-reducing means may include a plurality of bladders on an upper side thereof.

In accordance with a second aspect of the invention, an armrest comprises a base and a cover mounted on top of the base. The base includes a compartment defined therein for receiving articles. The cover includes an end pivotally connected to a first end of the base. A second end of the base includes a first engaging member, and the cover includes a second end with a second engaging member for releasably engaging with the first engaging member. The first end of the base includes two spaced ears having aligned first pinholes. The end of the cover includes a pivotal block received between the ears and having a second pinhole. A pin is extended through the first pinholes of the ears and the second pinhole of the pivotal block. A reactive force-reducing means and/or a massage means is mounted to an upper side of the cover for reducing the reactive force as a result of exerting a force to the armrest.

When a user sitting in the chair is intended to leave the chair seat, he/she usually exerts a downward force to the armrest. The downward force is partially or fully absorbed by the bladders of the reactive force-reducing means. Thus, the bladders protect the user when trying to get up from the chair. The bladders may further provide a massage function.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
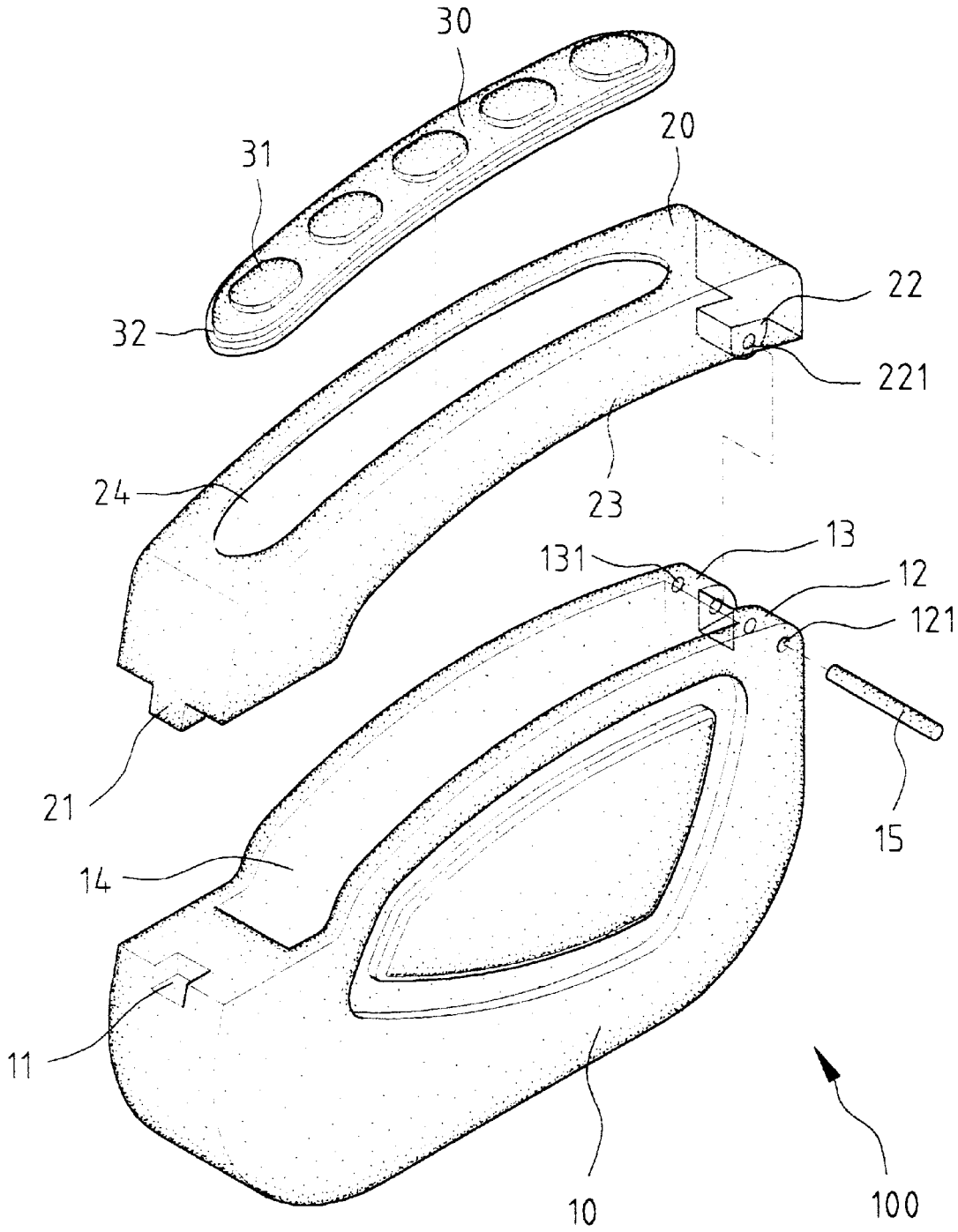
FIG. 1 is an exploded perspective view of a chair armrest in accordance with the present invention.
Figure 2:
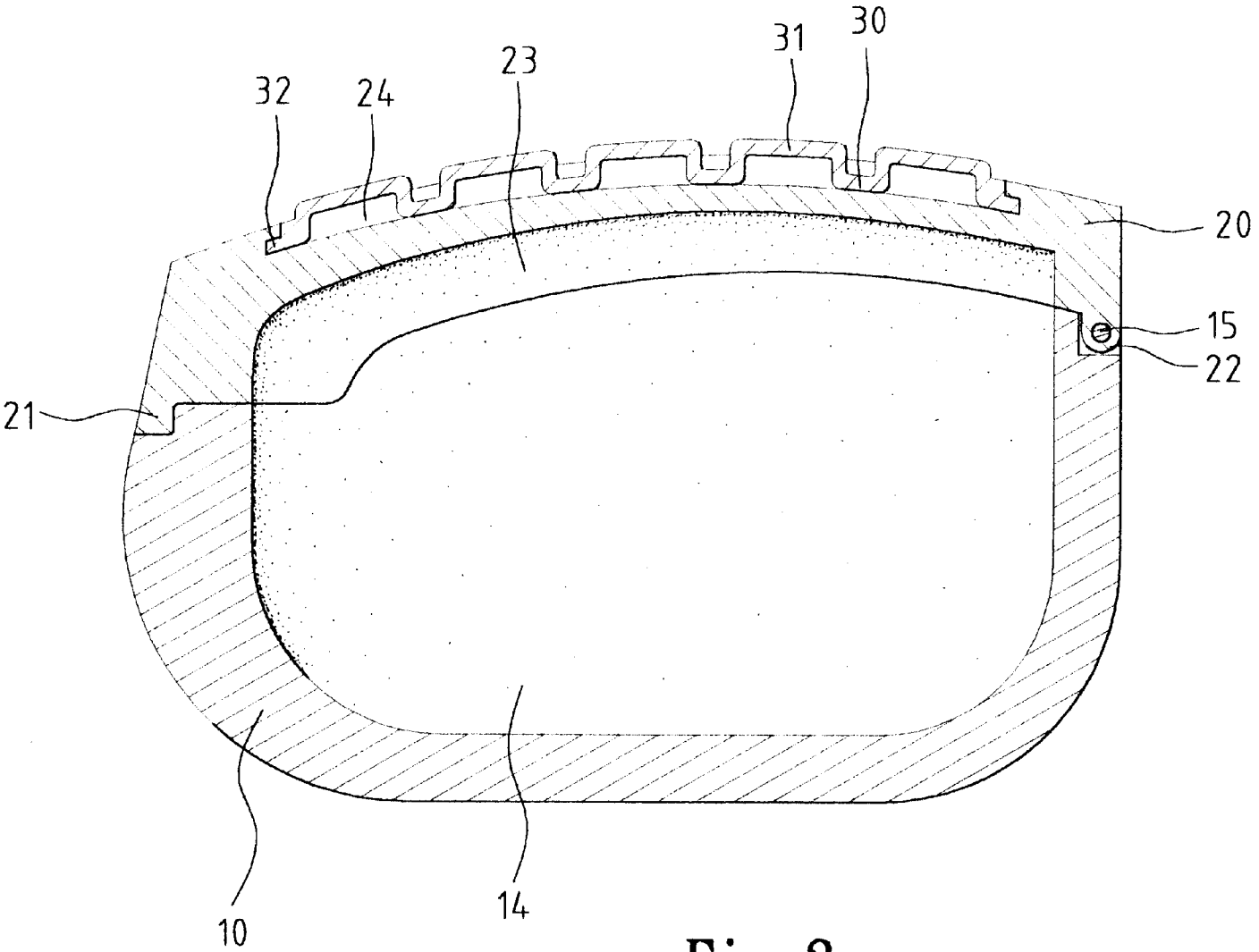
FIG. 2 is a longitudinal sectional view of the armrest.
Figure 3:
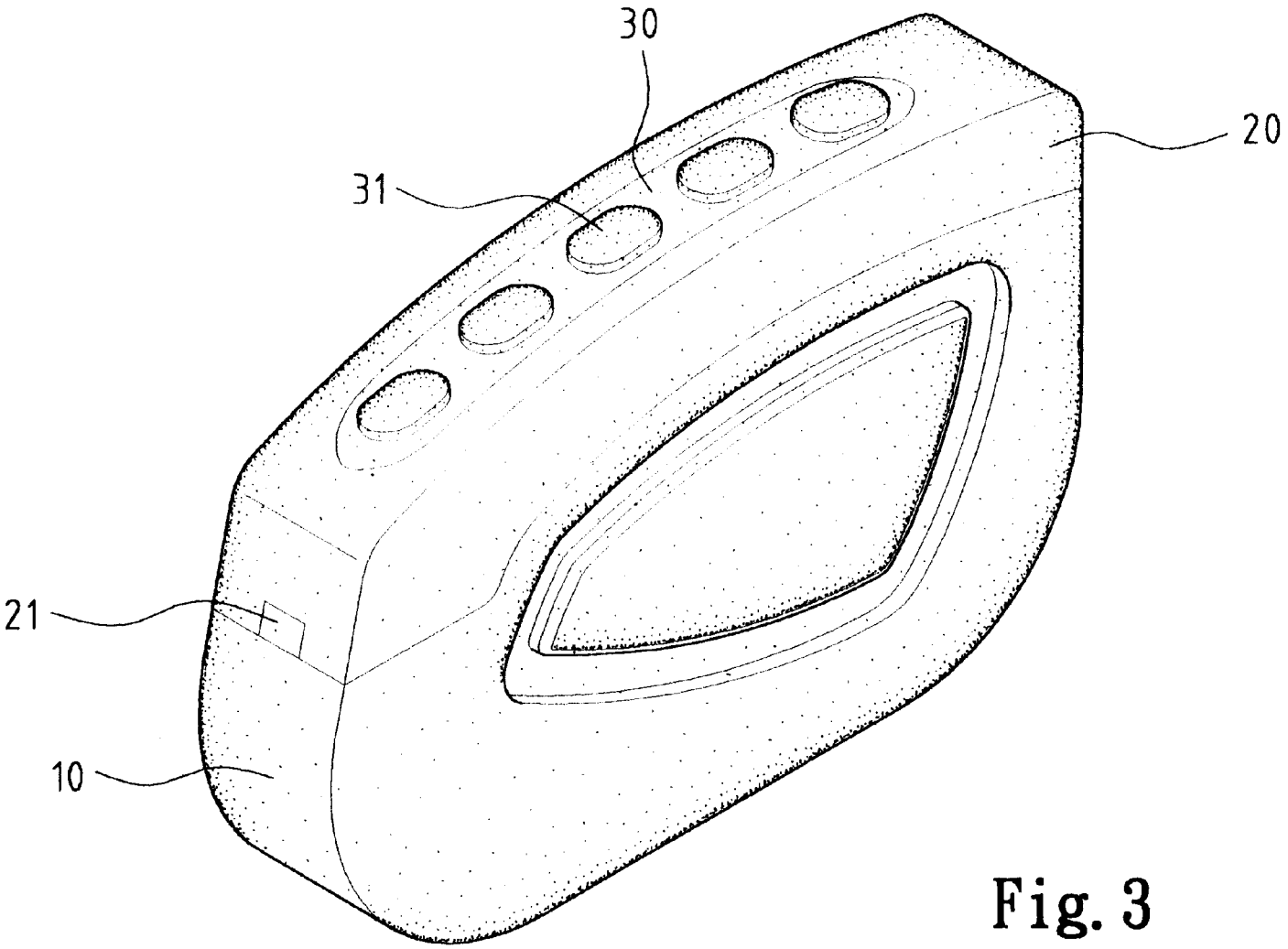
FIG. 3 is a perspective view of the armrest.

Referring to the drawings and initially to FIGS. 1 through 3, an armrest for chairs in accordance with the present invention is designated by "100" and generally includes a base 10, a cover 20, and a reactive force-reducing means 30. The base 10 includes a pair of spaced ears 12 and 13 formed on a first end thereof and a notch 11 defined in a second end thereof. The ears 12 and 13 include aligned pinholes 121 and 131. The base 10 further includes a compartment 14 defined therein.

The cover 20 includes a pivotal block 22 formed on an underside of a first end thereof. The pivotal block 22 is disposed between the ears 12 and 13, and a pin 15 is extended through the pinholes 121 and 131 and a pinhole 221 in the pivotal block 22, thereby forming a pivotal connection between the first end of the base 10 and the first end of the cover 20. The cover 20 further includes an engaging member 21 on a second end thereof for releasably engaging with the notch 11 of the base 10. The cover 20 further includes a slot 24 in a top face thereof. Each lateral wall (not labeled) of the cover 20 includes a recessed inner side 23.

The reactive force-reducing means 30 is mounted into the slot 24 of the cover 20. The reactive force-reducing means 30 includes a plurality of bladders 31 on an upper side thereof and a peripheral flange 32 so as to be securely held by an inner periphery that defines the slot 24 of the cover 20. Each bladder 31 contains air or suitable fluid therein.

Figure 4:
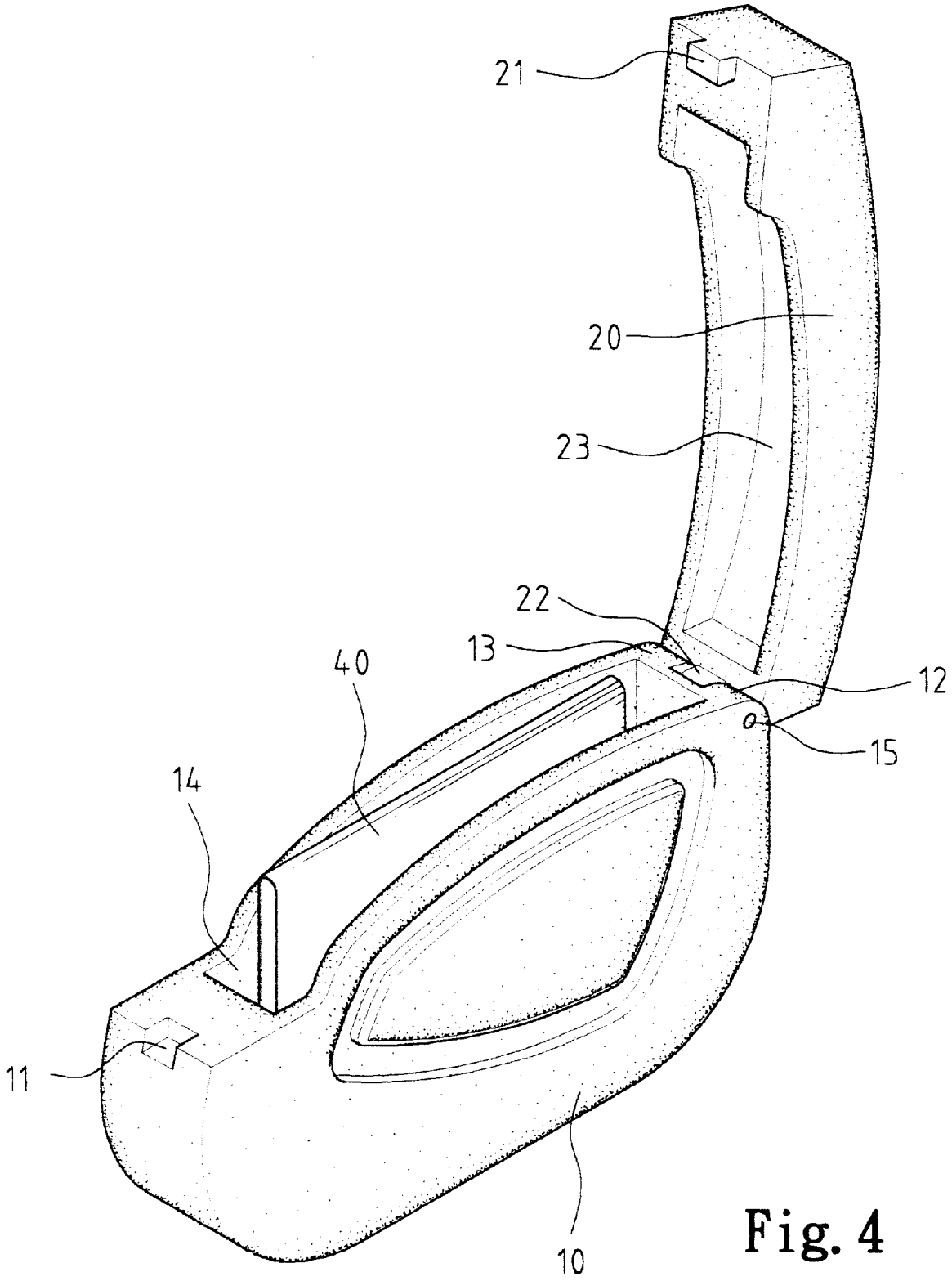
FIG. 4 is a perspective view of the armrest in an opened status.

The armrest 100 in FIG. 4 is in an opened status to allow the user to put articles 40 into the compartment 14 or remove articles 40 out of the compartment 14. Thus, the user may put magazines, favorite books, and other articles that are often used in the compartment 14 for easy and convenient access.

Figure 5:
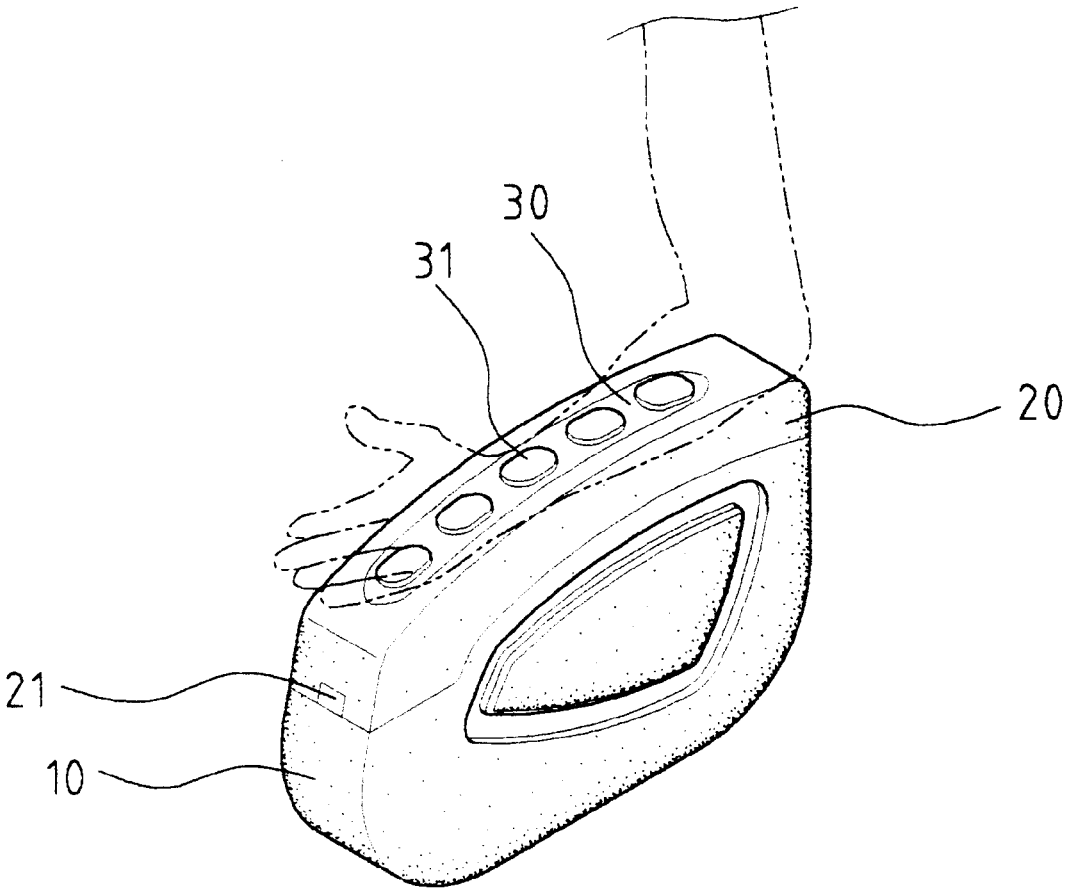
FIG. 5 is a schematic view illustrating function of the armrest as a shock-absorbing device.

Referring to FIG. 5, when a user sitting in the chair is intended to leave the chair seat, he/she usually exerts a downward force to the armrest 100. It is apparently that the downward force is partially or fully absorbed by the bladders 31 of the reactive force-reducing means 30. Thus, the bladders protect the user when trying to get up from the chair. The bladders 31 may further provide a massage function. Installation and assembly of the armrest of the present invention is simple and easy.

Although the invention has been explained in relation to its preferred embodiment, it is to be understood that many other possible modifications and variations can be made without departing from the spirit and scope of the invention as hereinafter claimed.

What is claimed is:

1. An armrest comprising a reactive force-reducing means mounted to an upper side thereof for reducing the reactive forces as a result of exerting a force to the armrest, wherein the reactive force-reducing means includes a plurality of bladders, and wherein the armrest includes a base and a cover mounted on top of the base, the reactive force-reducing means is mounted to an upper side of the cover.

2. The armrest as claimed in claim 1, wherein the base includes a compartment defined therein, a first end, and a second end, and wherein the cover includes an end pivotally connected to the first end of the base.

3. The armrest as claimed in claim 2, wherein the second end of the base includes a first engaging member, and the cover includes a second end with a second engaging member for releasably engaging with the first engaging member.

4. The armrest as claimed in claim 2, wherein the first end of the base includes two spaced ears having aligned first pinholes, and wherein the end of the cover includes a pivotal block received between the ears and having a second pinhole, and a pin being extended through the first pinholes of the ears and the second pinhole of the pivotal block.

* * * * *